US011253113B2

(12) United States Patent
Zerweck et al.

(10) Patent No.: US 11,253,113 B2
(45) Date of Patent: Feb. 22, 2022

(54) DISPENSER FOR DISPENSING SHEET PRODUCTS

(71) Applicant: Essity Hygiene and Health Aktiebolag, Gothenburg (SE)

(72) Inventors: Jason Zerweck, Philadelphia, PA (US); Rui Zhang, Philadelphia, PA (US)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 92 days.

(21) Appl. No.: 16/606,052

(22) PCT Filed: Apr. 18, 2017

(86) PCT No.: PCT/EP2017/059119
§ 371 (c)(1),
(2) Date: Oct. 17, 2019

(87) PCT Pub. No.: WO2018/192636
PCT Pub. Date: Oct. 25, 2018

(65) Prior Publication Data

US 2021/0106188 A1 Apr. 15, 2021

(51) Int. Cl.
*A47K 10/42* (2006.01)
*A47K 10/44* (2006.01)

(52) U.S. Cl.
CPC ..... *A47K 10/427* (2013.01); *A47K 10/44* (2013.01)

(58) Field of Classification Search
CPC ..... A47K 10/44; A47K 10/423; A47K 10/427
See application file for complete search history.

(56) References Cited

U.S. PATENT DOCUMENTS 2,337,065 A * 12/1943 Price ..... A47K 10/44 221/15
3,009,604 A * 11/1961 Gothreau ..... A47K 10/44 221/23

(Continued)

FOREIGN PATENT DOCUMENTS

CN 1250358 A 4/2000
CN 1346247 A 4/2002

(Continued)

OTHER PUBLICATIONS

European Patent Office, International Search Report and Written Opinion of the International Searching Authority, International Application No. PCT/EP2017/059119, dated Dec. 22, 2017 (13 pages).

(Continued)

*Primary Examiner* — Gene O Crawford
*Assistant Examiner* — Kelvin L Randall, Jr.
(74) *Attorney, Agent, or Firm* — Wood Herron & Evans LLP

(57) ABSTRACT

Dispenser for dispensing sheet products stacked in a stacking direction comprising a housing having first opposite side walls and second opposite side walls defining an interior space configured to accommodate the stack of the sheet products, the housing defining a dispensing opening at a front end of the first and second opposite side walls, and an engagement surface arranged at a front end portion of each of the first opposite side walls closer to one of the second opposite side walls than to the other of the second opposite side walls, wherein the engagement surfaces are engageable with respective opposite edges of the sheet products and extend in the stacking direction.

10 Claims, 6 Drawing Sheets

(56) References Cited

U.S. PATENT DOCUMENTS

| | | | | |
|---|---|---|---|---|
| 3,381,852 | A | 5/1968 | Bastian | |
| 3,726,435 | A * | 4/1973 | Williams | A47K 10/24 221/59 |
| 4,005,801 | A * | 2/1977 | Musser | B65B 43/14 221/56 |
| 4,094,442 | A | 6/1978 | Radek | |
| 4,372,549 | A * | 2/1983 | Stiernspetz | B65H 3/0638 271/23 |
| 6,352,172 | B1 * | 3/2002 | Chan | A47K 10/426 221/63 |
| 6,419,113 | B1 | 7/2002 | Tramontina | |
| 6,422,416 | B1 * | 7/2002 | Tramontina | A47K 10/424 221/45 |
| 7,178,689 | B2 * | 2/2007 | Wieser | A47K 10/422 221/45 |
| 2013/0221019 | A1 | 8/2013 | Rozek | |
| 2015/0327736 | A1 * | 11/2015 | Formon | A47K 10/424 221/1 |
| 2016/0090229 | A1 * | 3/2016 | Stenberg | A47K 10/427 221/1 |

FOREIGN PATENT DOCUMENTS

| | | | |
|---|---|---|---|
| CN | 1767779 | A | 5/2006 |
| CN | 102171117 | A | 8/2011 |
| CN | 102803096 | A | 11/2012 |
| CN | 106455875 | A | 2/2017 |
| EP | 2309906 | B1 | 4/2013 |
| EP | 2751002 | B1 | 11/2016 |
| FR | 62389 | E | 6/1955 |
| JP | 4847626 | B1 | 12/2011 |
| KR | 101535120 | B1 | 7/2015 |
| WO | 984002 | A1 | 1/1998 |
| WO | 2014154282 | A1 | 10/2014 |
| WO | 2016122362 | A1 | 8/2016 |

OTHER PUBLICATIONS

European Patent Office, International Preliminary Report on Patentability, International Application No. PCT/EP2017/059119, dated Mar. 18, 2019 (14 pages).

Russian Federal Service for Intellectual Property, Official Action issued in corresponding Russian Application No. 2019136737(072556) dated May 14, 2020, including English translation, 16 pages.

Federal Service for Intellectual Property, Decision to Grant, Russian Application No. 2019136737/28(072556) dated Aug. 4, 2020, including English translation, 12 pages.

National Intellectual Property Administration (CNIPA) of the People's Republic of China, Office Action, Application No. 201780086801.6, dated Feb. 26, 2021 (14 pages).

* cited by examiner

DISPENSER FOR DISPENSING SHEET PRODUCTS

CROSS-REFERENCE TO RELATED APPLICATION

The present application is a national stage entry under 35 U.S.C. § 371 of, and claims priority to, International Application No. PCT/EP2017/059119, filed Apr. 18, 2017, the disclosure of which is hereby incorporated herein by reference in its entirety.

FIELD OF THE INVENTION

The present disclosure relates to a dispenser configured to contain and dispense sheet products, particularly sanitary paper sheet products such as hand towels, paper napkins, facials, toilet paper or other wiping products in sheet form.

BACKGROUND OF THE INVENTION

Sheet products are generally stacked and accommodated in an interior space of a housing of the dispenser, the interior space being defined by opposite first side walls and opposite second side walls. The individual sheet products may be folded. Comfortable dispensing of the folded sheet products from the dispenser is enabled by interfolding consecutive sheet products. Thus, when a folded sheet product is pulled out through a dispensing opening of the dispenser, the immediate next (consecutive) folded sheet product is also subject to a pulling force making the immediate next folded sheet product partially protrude from the dispensing opening and being partially unfolded. Thus, this protruding part is easily accessible and can be gripped by a user.

Refills for those kinds of dispensers are constituted by stacks of sheet products smaller in size than the interior space. Even if a larger stack is available, the user will separate the stack into smaller stacks for refilling. In either case, more than one stack is loaded in the dispensers. In addition, those dispensers are frequently refilled before the last sheet has been dispensed, i.e., before the dispenser is completely empty. When a new stack of sheet products is loaded on top of a previous stack of sheet products, there is a so-called "bundle break" or "stack separation" between the stacks. The break is a discontinuity between surfaces, such that sliding friction at the break is generally less than sliding friction between other napkins in the stack. As a result, there is a risk that the immediate next folded sheet product will not be subjected to enough pulling force at a bundle break and, hence, will not partially protrude from the dispensing opening.

In manual dispensers, in which a sheet product is dispensed by manually gripping and withdrawing a sheet product through the dispensing opening, this may make it more difficult to remove the sheet product from the dispenser with a certain risk that more sheet products are withdrawn from the dispenser than necessary.

Considering automatic dispensers, comprising a dispensing mechanism actuated by the user to automatically dispense a specific number of sheet products, multiple sheet products (up to the bundle break) may dispense simultaneously instead of individually as intended. Hence, also in this case there is a risk that more sheet products are ejected from the dispenser than necessary.

SUMMARY OF THE INVENTION

It is desired to provide a dispenser reliably preventing or at least reducing the risk of the wrong number of sheet products being dispensed at or approaching a bundle break.

Another aim is to provide a dispenser in which it can be ensured that the immediate consecutive sheet product protrudes from the dispensing opening after withdrawal of a sheet product even at a bundle break.

According to one aspect, a dispenser for dispensing sheet products is suggested.

The dispenser can be particularly configured for dispensing sanitary paper products in sheet form. Examples of sanitary paper products are hand towels, paper napkins, facials, toilet paper or other wiping products in sheet form. The sheet products may be made of tissue paper (ISO 12625-1) or nonwoven (ISO 9092).

The dispenser can be further configured to accommodate a plurality of sheet products in form of a stack. Thus, the dispenser may have a longitudinal extension in the direction of stacking. Within the stack, the sheet products may be folded and even interfolded, wherein any interfolding technique may be implemented, such as but not limited to those described in EP 2 309 906 B1 or EP 2 751 002 B1. In this context, interfolding is to be understood in that at least one panel of a first sheet product is sandwiched between two panels of a second sheet product adjacent to the first sheet product in the stack and one panel of a third sheet product is sandwiched between two panels of the second sheet product, the third sheet product being adjacent to the second sheet product in the stack, and so on. As described earlier, the benefit of interfolding is when a leading folded sheet product is pulled out through a dispensing opening of the dispenser, the immediate next (consecutive) folded sheet product is also subject to a pulling force making the immediate next folded sheet product partially protrude from the dispensing opening and being partially unfolded. A plurality of stacks of interfolded sheet products may be contained in the dispenser, wherein the sheet products at an interface between two consecutive stacks are not interfolded, which is often referred to as a bundle break.

The suggested dispenser includes a housing to accommodate the stack of the sheet products. The housing has first opposite side walls (e.g., sides) and second opposite side walls (e.g., a bottom and a top) defining an interior space (compartment). The stack of sheet products is accommodated in the interior space. The interior space may be larger in cross-section than the footprint of the stack of sheet products. As a result, the edges of the sheet products do not engage with at least the first opposite side walls and in some embodiments with the top. Further, the housing defines a dispensing opening which may be positioned at one end of the interior space. In other words, the dispensing opening is positioned at a front end of the first and second side walls. The front end of the first and second side walls may in one example be opposite to a back wall. The housing of the dispenser may have a support surface or a pedestal configured to place the housing on a horizontal surface. Alternatively, the housing may be configured for mounting on a vertical wall or post. It is also conceivable to mount the housing directly to a counter in a substantially vertical orientation or to configure the pedestal to support the housing in said substantially vertical orientation when placed on a horizontal surface. Furthermore, the dispensing opening may be directed in any suitable direction when the housing is in use including a downward, an upward, a forward or any intermediate direction.

An engagement surface is arranged at the front end portion of each of the first opposite side walls (e.g., the sides) and, hence, adjacent the dispensing opening. The housing may hide the engagement surfaces so that they are not visible through the dispensing opening. The engagement surfaces are further disposed closer to one of the second opposite side walls than to the other of the second opposite side walls. In a particular example, the engagement surfaces are disposed closer to the top than to the bottom. Even further, the engagement surfaces may be located at an upper end portion of the first opposite side walls at which the first opposite side walls connect to one of the second opposite side walls (e.g., the top). In this context, "end portion" means a portion of up to 2 cm or 3 cm starting from the end at which the first opposite side walls connect to the one of the second opposite side walls (e.g., the top). The engagement surfaces are configured so that they are engageable with respective opposite edges of the sheet products. The engagement surfaces further extend in the stacking direction so as to engage with a plurality of opposite edges of consecutive sheet products in the stack (in the stacking direction). Thus, the engagement surfaces have a certain length in the stacking direction. The length is particularly governed by the desired effect of increasing the friction between the folds of the leading sheet products. In this context, it may be sufficient that the engagement surfaces engage with the first six, or the first four or even only the first two folds of the sheet products in the stack closest to the dispensing opening. Thus, a length of less than 40 mm is sufficient. Yet, the length should at least be 5 mm. In an example, the length resides between 9 mm and 30 mm. In a particular example, the length is about 24 mm. A width of the engagement surfaces is particularly constrained by the available assembly space. Particularly, if the engagement surfaces are to be positioned between a roller of a dispensing mechanism (see below) and the top edge of a sheet product, a width of less than 20 mm is appropriate. Yet, the width should at least be 4 mm. In an example, the width resides between 4 mm and 15 mm. A particular example has a width of 10 mm. The engagement surfaces provide for a friction modification between sheet products and/or folds of sheet products in that the friction between two consecutive folds and/or sheet products becomes highest at the front of the stack at the dispensing opening. Thus, it may even at a bundle break (stack separation) be ensured that in at least most cases the correct number of sheet products can be dispensed at a time. In addition, arranging the engagement surfaces at the first opposite side walls provides for an increased friction at opposite side edges of the sheet products. Thus, the sheet products tend to bulge at a center between the opposite side edges in a direction towards the dispensing opening and being restrained or retained at the opposite side edges by the engagement surfaces. Thus, singularizing the sheet products at the bulged edge is simplified. This effect is even increased, when the stack of sheet products is urged towards the dispensing opening either by gravity or by a support plate as described in more detail below. As described earlier, the engagement surfaces may be located closer to a top wall than to a bottom wall. In this example, the sheet products rest on the bottom wall and are bulged at their top edge. When the dispenser is an automatic dispenser comprising a roller as described in more detail below, the roller will likely be positioned behind an upper edge of the dispensing opening and, thus, engage with the top edge of the sheet products. As the sheet products are bulged at the top edge in this example, singularizing the sheet products by the roller may be simplified.

In one example, the engagement surfaces are each inclined relative to an inner surface of the respective first opposite side walls so that a distance between the engagement surfaces decreases toward the dispensing opening. As a result, the sheet products are guided towards the dispensing opening with an increasing friction between the sheet products or their folds in a direction toward the dispensing opening with the highest friction at the leading sheet product. In one particular example, the angle of inclination between the engagement surface and the respective side wall may be in the range of 5° and 30°. In another example, the angle of inclination may be in the range of 10° and 20°. In one particular example, the angle is about 15°.

The sheet products, which may be loaded into the dispenser, may have different widths in a direction between the first opposite side walls or may be displaced relative to each other in a width direction. This may be caused by different articles being loaded into the dispenser as regards stiffness, paper quality, thickness, number of folds, etc. Therefore, it is advantageous that one of the engagement surfaces or even both engagement surfaces is/are elastically biased towards each other. In one example, only one of the engagement surfaces is elastic biased towards the other, whereas the other is rigid. In other examples, both engagement surfaces are elastically biased towards each other. Due to the elasticity, the distance between the engagement surfaces is automatically adapted to the width of the sheet products and sheet products of different width may be accommodated in the interior space still being engaged with the engagement surfaces. In this context, care has to be taken that the spring force is not too high so that the sheet products are prevented from being conveyed to the dispensing opening and so that the sheet products are not damaged. On the other hand, the spring force cannot be too low, because in this case the engagement surfaces would not make sufficient contact with the edges of the sheet products to achieve the desired effect.

In one example, a movable arm is attached to one of the first opposite side walls, wherein the arm is biased toward the other of the first opposite side walls by an elastic member such as a spring. The engagement surface is provided on the arm.

In another example, a solid attachment member provided with the engagement surface can be provided, wherein the attachment member is made of an elastic material to provide for said elasticity.

It has been proven advantageous regarding simplification of the manufacturing process and saving costs, that at least one of the engagement surfaces is formed on a tab, wherein the tab is elastic in a direction towards the respective side wall of the first opposite side walls. According to an example, a single tab of plastic or metal material may be provided and attached to the side wall at one of its ends in an angled fashion, the material being elastic when being pushed towards the side wall tending to spring back.

In another embodiment, the tab may be a leg spring or a leaf spring.

The tab may be manufactured from plastic material. As an example, the engagement surface and the plastic tab may be integrally formed in a two-component injection molding process. Yet, it may even be advantageous from the viewpoint of durability and elasticity to use a bent sheet metal as the tab. In this example, it may be beneficial to provide an opening in the sheet metal to be engaged with an engagement member of the engagement surface in order to provide the engagement surface on the tab. Thus, the engagement surface or an engagement surface member comprising the engagement surface can be snapped onto the tab. It is also conceivable to glue, weld or attach the engagement surface by use of an attachment member such as bolts or screws to the tab.

The engagement surfaces may be a friction increasing or surface-increasing surface. A surface-increasing surface is to be understood as a surface having a larger surface area as compared to a planar surface of the same dimension in plan view. For example, a plastic material may be used as the engagement surface to provide for a friction increasing surface. The material may even be an elastic material, such as rubber. The engagement surface may for example be textured, stepped or have the surface of a sandpaper to provide for the surface-increasing surface. Thus, it can be secured that the edges of the sheet products are engaged and their movement toward the dispensing opening is limited, whereby the friction can be increased between the leading sheet products and/or their folds.

According to a further example, at least a part of the engagement surfaces may each comprise a plurality of parallel grooves arranged in a row in the stacking direction (e.g., from a back wall (or the support plate) to the dispensing opening). The grooves are intended to apply a backward pressure to the stack of sheet products so that the friction between a second fold and/or a sheet product to subsequent folds and/or sheet products is increased relative to the friction between the first and second fold and/or sheet product in the stack. Thus, when a sheet product is a slid relative to the consecutive sheet product during dispensing, the edge engaged with the engagement surface, particularly the groove, slides along the groove with less friction between the edge and the engagement surface, thus simplifying dispensing of the sheet product. In addition, separation of consecutive sheet products is simplified. The width of the grooves may differ over the length of the engagement surface in the stacking direction. The distance between the center of directly adjacent grooves may be within a range of 1.5 mm and 7 mm. In one particular example the distance is about 3 mm. In addition, the grooves may have a triangular cross-section with an angle between the side flanks of the groove between 100° and 150°, e.g., about 121.5°. Yet, other forms of grooves, such as U-shaped grooves or rounded grooves leading to wave shaped engagement surface in cross-section are as well conceivable.

Even further, the housing may include a housing body and a cover (or lid). The cover is movably attached to the housing body so that the cover can be moved between an open refilling position and a closed use position in order to enable refilling of the dispenser with one or more stacks (bundles) of sheet products. In this context, the cover may be rotatably and/or translationally movable between the two positions. According to one aspect, the cover is, however, rotatable about an axis of rotation. According to an example, the dispensing opening is defined in the cover. As a result, the dispensing opening moves together with the cover when the cover is moved to the open refilling position or the closed use position. According to an embodiment, the engagement surfaces are attached to the housing body and particularly its sides (first opposite side walls). According to another example, the engagement surfaces are, however, arranged on and movable together with the cover. As a consequence, the engagement surfaces are moved out of the way when opening the cover and do not interfere with a refill being loaded into the interior space formed in the housing body. As a result, loading of the dispenser is simplified.

The dispenser may be a manual dispenser in which the sheet products are dispensed by a manual pulling force. Alternatively, the dispenser may be an automatic dispenser including a dispensing mechanism configured to dispense a specific number (one or more) of sheet products at a time. It is as well conceivable that the dispensing mechanism only dispenses a part of the sheet product and that the entire sheet product is withdrawn from the dispenser manually. The dispensing mechanism may be mechanically or electrically triggered. According to an embodiment, the dispensing mechanism may comprise one or more rollers which is/are rotatable about an axis of rotation. The roller/-s is/are engageable with a leading sheet product (a first sheet product closest to the dispensing opening) in the stack of sheet products and configured to dispense the specific number of sheet products upon rotation. The axis of rotation may extend parallel to the second opposite side walls. In this example, the engagement surfaces modify the friction characteristics between the separate sheet products directly before the roller. In particular, the friction between folds of the sheet products is increased in an ascending fashion so that only one fold (the first, lowest friction fold) is dispensed at a time.

According to an example, the engagement surfaces are arranged (as seen in a direction parallel to the first opposite side walls) between the axis of rotation and that side wall (e.g., top wall) of the second opposite side walls to which the engagement surfaces are located closer to. Hence, in one example, the engagement surfaces are arranged between the axis of rotation of the roller/-s and the top wall. Further, the engagement surfaces are located immediately upstream of the roller/-s in a stacking direction from the back wall to the dispensing opening. In that the engagement surfaces are positioned adjacent the roller/-s, the modification of the friction between the folds of the sheet products occurs at a position at which the most sliding friction occurs, wherein the sliding friction is initiated by the rotation of the roller/-s. In addition, due to this arrangement, the sheet products are free for presentation when moved under the roller/-s and dispensed through the dispensing opening.

As previously described, a stack accommodated in the interior space is urged in a direction toward the dispensing opening. If the housing is for example mounted on a vertical wall and the dispensing opening is directed downward, the stack of sheet products is urged toward the dispensing opening by gravity. According to an embodiment, the dispenser may, however, have a support plate reciprocally movable within the housing and having a support surface for supporting the stack of sheet products at one of opposite faces of the stack. According to a particular aspect, the support plate and its support surface are arranged so as to support that face of the stack of sheet products facing away from the dispensing opening (the last sheet of the stack). Further, the support plate may be positioned distanced from the axis of rotation of the cover, when the dispenser is filled with sheet products. Even further, the direction of movement of the support plate may be perpendicular to the axis of rotation of the cover.

The support plate is urged in a direction toward the dispensing opening in order to continuously feed the sheet products to the dispensing opening. This may be achieved by implementing an elastic member, such as a spring operable between the support plate and the housing body and tensioned in the direction of the dispensing opening when the dispenser is filled with sheet products. In one particular example, a constant force spring may be employed. For example, a first end of the sheet like constant force spring may be attached to the housing body and a second opposite end of the constant force spring may be attached to a rotatable axis mounted to the support plate. The constant force spring tends to coil and is extended (uncoiled) upon movement of the support plate away from the dispensing opening during filling of the dispenser with one or more stacks of sheet products. Upon dispensing of the sheet products, the stack decreases and the constant force spring continuously coils accompanied by a rotation of the axis thereby moving the support plate towards the dispensing opening. Yet, other elastic members may as well be used, such as a tension spring.

According to an aspect, the length of the engagement surfaces in the stacking direction may be different. In particular, if the engagement surfaces are provided on the cover as described earlier, the engagement surface located close to a pivot axis of the cover, at which the cover is hinged to the housing body, may likely interfere with the stack of sheet products upon closing of the cover. Accordingly, the engagement surface located closer to the pivot axis is made shorter in length in the stacking direction than the other of the engagement surfaces.

Further aspects of the present disclosure may be found in the following description of a particular embodiment making reference to the accompanying drawings.

DETAILED DESCRIPTION OF THE INVENTION

Figure 1:
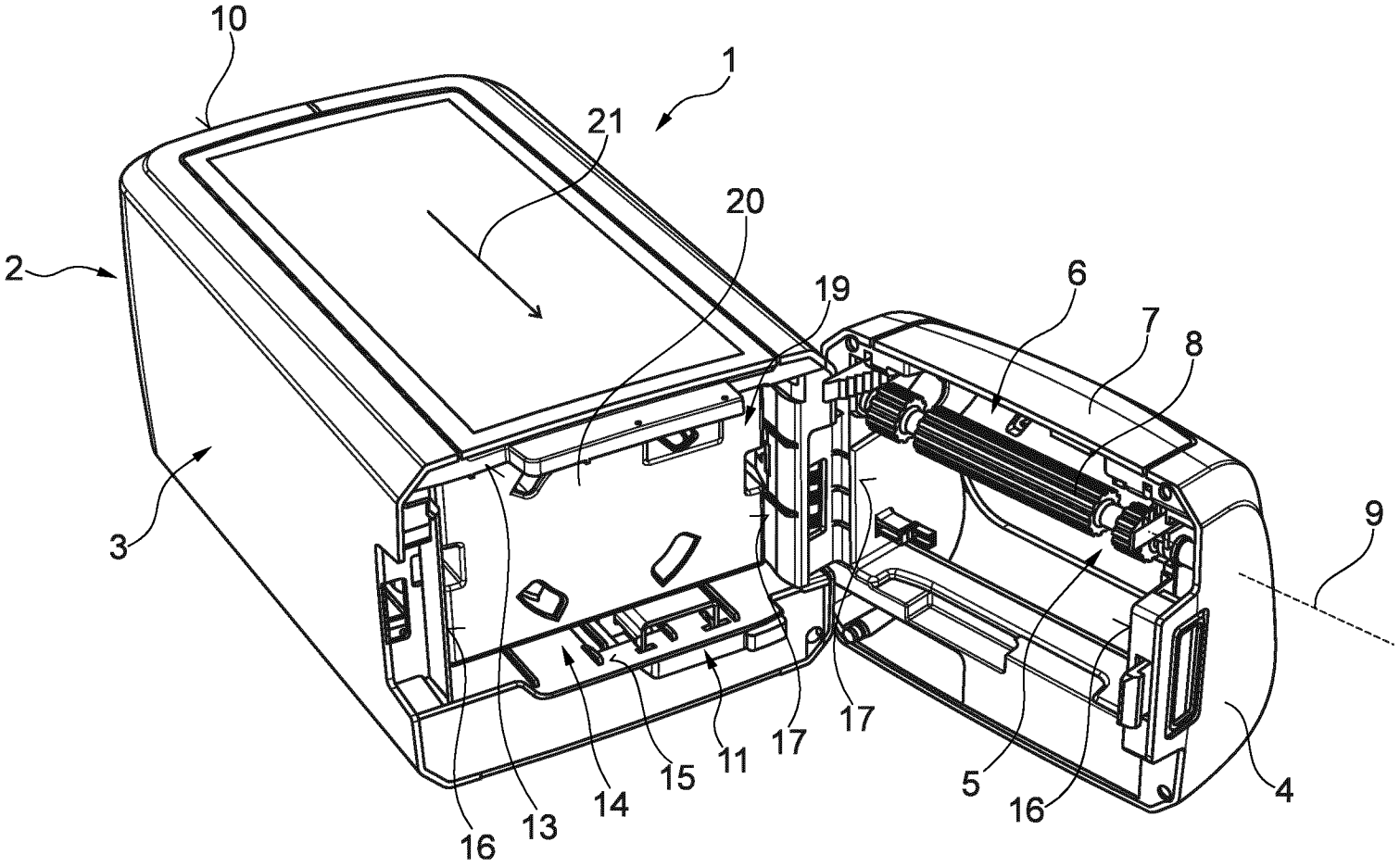
FIG. 1 shows a perspective view of a dispenser according to an embodiment in the open refilling position.

Throughout the drawings, the same reference numerals have been used for the same elements.

A particular embodiment of a dispenser 1 is described as an example with reference to FIGS. 1 to 5.

The dispenser 1 includes a housing 2 having a housing body 3 and a cover 4 (the cover may also be referred to as a door or lid). A dispensing opening 5 is provided at the front of the cover 4. The dispenser 1 is configured for being placed on a horizontal surface as shown in FIG. 1 and with the dispensing opening 5 directed forward. Yet, also other orientations of the dispenser 1 are conceivable such as with the dispensing opening 5 being directed downward or upward. A dispenser 1 having a downwardly oriented dispensing opening is for example known from WO 2014/154282 A1.

The cover 4 is hinged to the housing body 3 so as to be rotatable about a vertical axis. This has been proven advantageous for refilling the dispenser and the implementation of an automatic dispensing mechanism 6 incorporated into the cover 4. Yet, it is also conceivable that the cover 4 is rotatable about a horizontal axis or to attach the cover so as to be translationally and rotatably movable. In any case, the cover 4 is fixed to the housing body 3 so as to be movable between a closed use position (shown in FIGS. 2 and 3) in which the dispenser 1 is ready for dispensing sheet products and an open refilling position (shown in FIG. 1) allowing refilling (loading) of the dispenser 1. In the present embodiment, the cover 4 is rotated about the vertical axis for moving the cover 4 between the two positions.

As previously described, a dispensing mechanism 6 is incorporated into the cover 4. The dispensing mechanism 6 is driven by an electric motor for dispensing one or more sheet products at a time. The dispensing mechanism 6 may be triggered by a bottom 7 located on the cover 4. The dispensing mechanism 6 comprises a roller 8 rotatable about a rotation axis 9. The roller 8 has an outer surface made of rubber with a plurality of longitudinal grooves extending parallel to the axis of rotation 9. The roller 8 is configured to engage with the first sheet product (leading sheet product) in the stack of sheet products. As will be apparent from FIGS. 1 and 2, the roller 8 is located in a top end portion behind the refilling opening and hidden by the cover 4 so as to be invisible when the cover 4 is closed. The roller 8 is configured to engage with an upper end portion of the sheet products closer to an upper edge than to a lower edge resting on a bottom wall 14. In the present example, the roller 8 rotates about the axis of rotation 9 counterclockwise. Thus, the roller 8 engages with an upper end portion of the sheet product and upon rotation pulls the upper end portion downward through the dispensing opening 5, where it can be withdrawn. For this purpose, the stack of sheet products is urged toward and against the roller 8 via a support plate 19 as described further below. During this process, there is a relative movement between two consecutive folds of a sheet product or between two consecutive sheet products causing a sliding friction.

Yet, also other dispensing mechanisms known in the art are possible. Further, the engagement surfaces described in the following are also applicable to pure manual dispensers in which one sheet product at a time is dispensed by being manually pulled out of the dispensing opening 5 instead of using an automatic dispensing mechanism 6.

The housing body 3 of the housing 2 has opposite side walls 16, 17 (first opposite side walls), a top wall 13 and a bottom wall 15 (second opposite side walls) and defining a compartment 14 (interior space) for accommodating a stack of sheet products in a stacking direction 21. The housing body 3 further has a refilling opening 11 defined in a front wall 12. The cover 4 is hinged to the front wall 12 and configured to cover the refilling opening 11 in the closed use position and to give access to the refilling opening 11 in the open refilling position.

The compartment 14 is delimited at its lower side by the bottom wall 15 on which a lower edge of the sheet products may rest.

A support plate 19 is provided within the compartment 14. The support plate 19 has a support surface 20 for supporting a back face of the stack of sheet products (a last sheet product in the stack of sheet products contained in the dispenser 1). The support plate 19 is translationally movable along guides in a stacking direction 21.

The support plate 19 is urged toward the refilling opening 11 and, hence, the dispensing opening 5 of the shown dispenser 1. Accordingly, the support surface 20 of the support plate 19 pushes (urges) the stack of sheet products toward the dispensing opening 5. According to an example, this may be achieved by constant force springs 33 on either side of the support plate 19 as seen perpendicular to the direction of movement of the support plate 19. The constant force springs 33 tend to coil about a rotatable axis 34. One end of the longitudinal and sheet shaped constant force springs 33 is attached relative to the housing body 3, whereas the opposite end thereof is attached to the rotatable axis 34. Upon dispensing the sheet products from the dispenser 1, the support plate 19 is pushed by the springs 33 towards the front, wherein the springs 33 coil about the thereby rotating axis 34. Yet, also other mechanisms are conceivable such as a tension spring fixed at one end relative to the support plate 19 and at the other end relative to the housing body 3.

In the present example, engagement surfaces 22 are respectively arranged at the side walls 16, 17. The engagement surfaces 22 are arranged so as to be engageable with side edges of a plurality of sheet products arrayed in the stacking direction.

In particular, a tab 23 (see FIG. 5) made of a bent sheet metal is fixed to the cover 4 as shown in FIG. 1. The tab 23 is substantially V-shaped, though the legs of the "V" do not necessarily have to have the same length. An attachment leg 24 extends substantially parallel to the surface of the respective side wall 16, 17 to which it is attached. The support leg 25 is inclined relative to the attachment leg 24 and, hence, relative to the respective sidewall 16, 17 to which the tab 23 is attached. The attachment leg 24 and the support leg 25 are connected via a bent 26. Due to the elasticity of the material, the support leg 25 is, hence, urged away or biased away from the attachment leg 24 and springs back upon the compression of the legs 24, 25. The support leg 25 has engagement holes 27.

Figure 4:
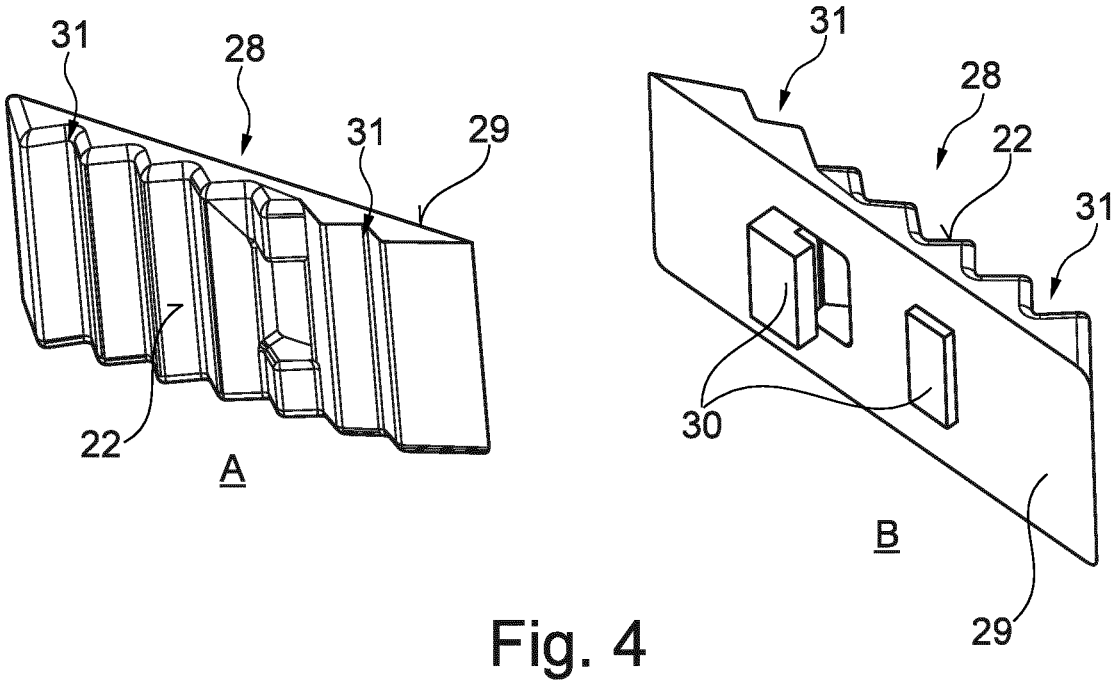
FIG. 4 shows an engagement surface member defining the engagement surface in a perspective front view (FIG. 4A) and a perspective back view (FIG. 4B)
Figure 5:
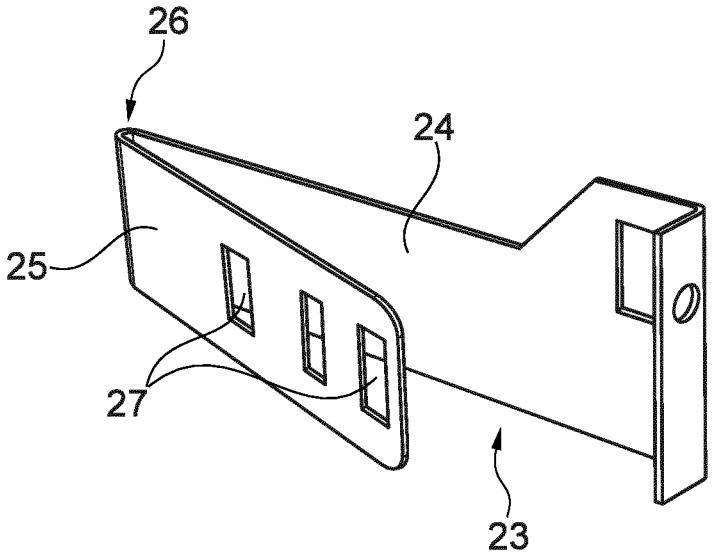
FIG. 5 shows a tab 23 used to for attaching the engagement surface member.

Moreover an engagement surface member 28 as shown in FIG. 4 defines the engagement surface 22. The engagement surface member 28 is made of plastic material. In one example, the engagement surface member 28 may be made of rubber. Yet, any other high friction material could be used as described earlier. The engagement surface member 28 has a back surface 29 opposite to the engagement surface 22. Engagement members 30 are formed on the back surface 29 and are configured to engage with the engagement holes 27 of the tab 23. Thus, the engagement surface member 28 can be snapped onto the tab 23 and is supported on the support leg 25. Yet, any other attachment technique could be used as described above.

As is also shown in FIG. 4, the engagement surface 22 comprises a plurality of grooves 31. The grooves 31 extend parallel to each other so that the engagement surface 22 is corrugated. In the mounted state and as shown in FIG. 1, the grooves 31 are arranged in a row in the stacking direction 21. Moreover, the grooves 31 extend in a direction from the bottom to the top or vice versa and in the example perpendicular to the axis of rotation 9 of the roller 8. The grooves are V-shaped. However, any other shape of the grooves such as U-shaped or rounded (wave-shaped) could be employed.

Figure 2:
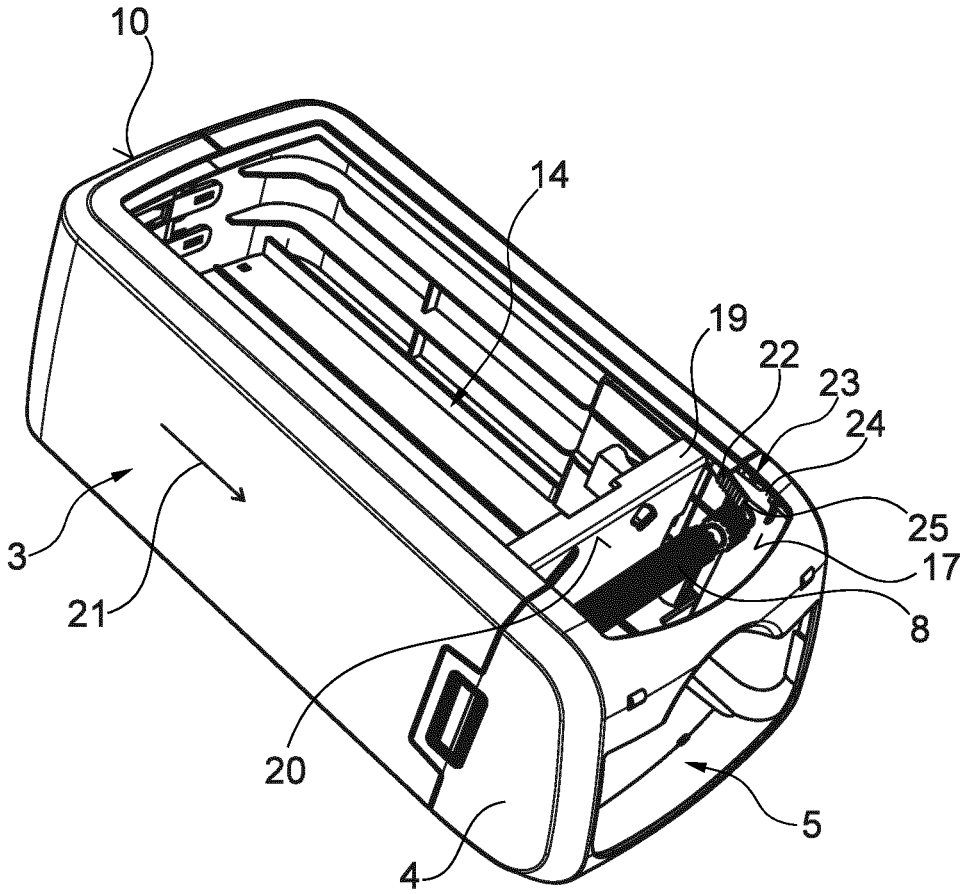
FIG. 2 shows a perspective view of the dispenser according to the embodiment in FIG. 1 in the closed use position with the top being removed.

In the mounted state and as shown in FIGS. 1 and 2, the tabs 23 including the engagement surface members 28, and as a result the engagement surfaces 22, are mounted between the roller 8 and the top wall 13. Thus, the engagement surfaces 22 are located at the side walls 16 and 17 closer to the top 13 than to the bottom 15. In the particular example, the engagement surfaces 22 are even located at the connection of the side walls 16, 17 with the top wall 13.

As will be apparent, the tabs 23 protrude from an inner surface of the cover 4 facing the housing body 3 and particularly the front wall 12. In order to accommodate the attachment leg 25 when closing the cover 4, indentations 32 are provided in the side walls 16 and 17 as shown in FIG. 1.

Figure 3:
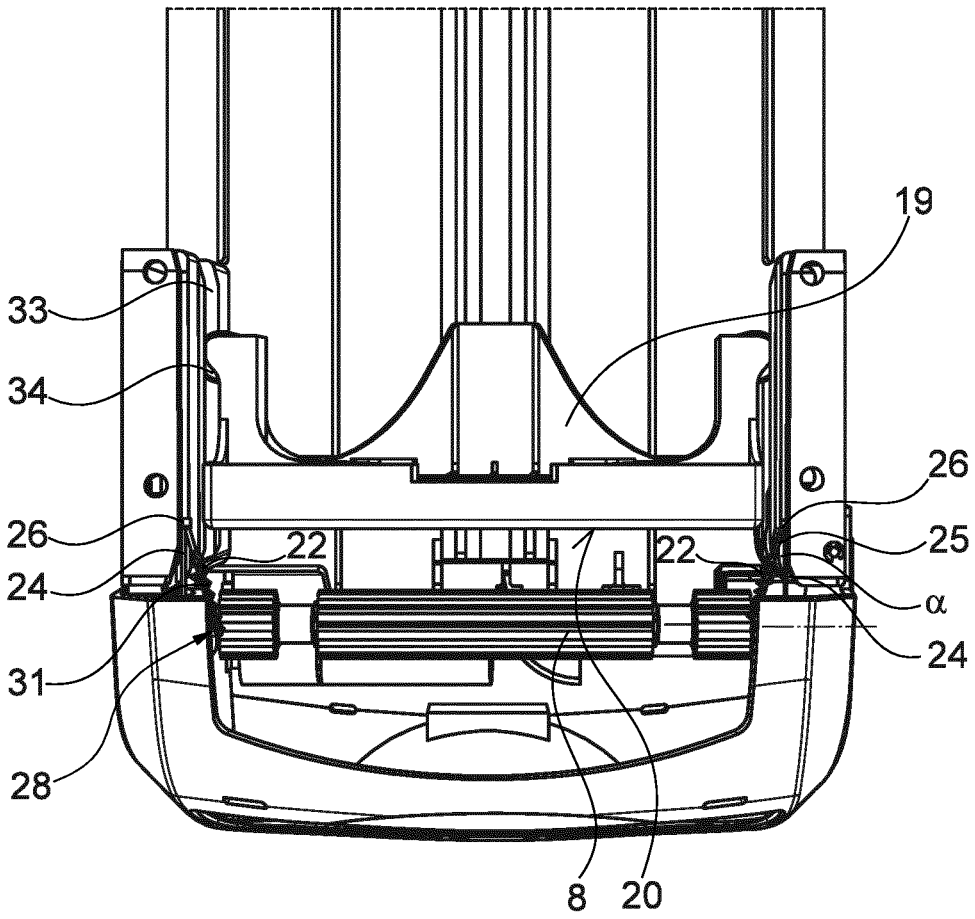
FIG. 3 shows a perspective top view of the dispenser in FIG. 2 with the further parts being removed to show the engagement surfaces.

It is also clear from FIGS. 1 to 3 that the engagement surfaces 22 are mounted at a front end portion of the side walls 16, 17. In this context, a front end portion is a portion closer to the dispensing opening 5 than to the back wall 10 or even more accurately a portion adjacent or near the dispensing opening 5.

Due to the mounting of the tab 23 and its configuration, the engagement surfaces 22 which are attached to the tabs 23 are biased towards each other. In particular, the support leg 25 is elastically urged away from the respective sidewall 16, 17. Thus, if a force is applied on the engagement surfaces 22, the spring force of the leg 25 biases the engagement surfaces 22 away from the respective side wall 16, 17 and therefore towards each other.

As previously described, the engagement surfaces 22 are mounted on opposite sides, i.e., one at each side wall 16 and 17. Due to the support leg 25 to which the engagement surfaces are attached being inclined relative to the attachment leg 24 which is attached to the respective sidewall 16, 17, the engagement surfaces are each inclined so that a distance between the engagement surfaces decreases towards the dispensing opening 5 as best seen in FIG. 3. In the present example the angle of inclination a between the support leg 25 and the attachment leg 24 and, hence, the engagement surface 22 and the sidewall 16, 17 is about 20°.

The engagement surfaces 22 are, by this arrangement, engageable with opposite side edges of sheet products stacked in the compartment 14. The opposite side edges would likely extend parallel to the side walls 16, 17 but be out of contact with the side walls. In other words, the cross-section defined by the side walls 16, 17, the bottom 15 and the top 13 is larger than the footprint of the sheet products toward the stack of sheet products. Thus, the sheet products in this particular example will rest on the bottom 15 and there will be a gap between the sheet products and the side walls 16, 17 and the top 13.

As the sheet products are fed towards the dispensing opening 5 by the support plate 19, the side edges of the sheet products engage with the engagement surfaces 22. Due to the inclination of the engagement surfaces 22 and the decreasing distance towards the dispensing opening 5, the sheet products are guided into engagement with the engagement surfaces 22. Further, due to the elasticity of the support leg 25 and, therefore, the elasticity of the engagement surfaces 22, differences in width of the sheet products may be compensated and the engagement surfaces 22 will always be in secure engagement with the side edges thereof. Thus, the further movement of the sheet products will be restrained at their top on opposite side edges by the engagement with the engagement surfaces 22. Due to the inclination of the engagement surfaces 22, the sheet products will be restrained from moving further forward the more they approach the dispensing opening 5. Thereby the friction between consecutive folds of sheet products and/or consecutive sheet products will be modified and particularly be increased in ascending fashion, the more the sheet products approach the dispensing opening 5. Concurrently and because the sheet products are further urged forward by the support plate 19, a top center of the sheet products will move further forward than the side edges restrained by the engagement surfaces 22. As a consequence, the sheet products will bulge forward at the top center. As a consequence, there is only low friction between consecutive folds or sheet products in the top center. This simplifies gripping/engaging of an upper edge of the sheet products by the roller 8 and, hence, one sheet product at the time can be dispensed more accurately. In addition, due to the arrangement of the grooves 31 in a direction parallel to the side edges of the sheet products, the friction of the side edges relative to the engagement surfaces 22 is relatively low when the leading sheet product is slid down by the rotation of the roller 8 in the counterclockwise direction. In other words, the leading sheet product is pulled down by the roller 8, whereby the side edges slide along the grooves 31 out of contact with the engagement surfaces 22. Thus, the sheet product can reliably be presented via the dispensing opening 5.

The present invention has been described with respect to a particular embodiment. However, it is clear that variations of this embodiment are possible within the scope of the appended claims. For example, the engagement surface members 28 may rigidly be fixed to the side walls 16, 17 instead of using the tab 23 which is elastic. It is also possible to fix one of the engagement surface members rigidly and the other of the engagement surface members elastically to the side walls. It is also conceivable to use other mechanisms to provide for the elasticity than the tab 23. For example, a hinged arm can be used which is urged away about its pivot by a spring. Moreover, the engagement surfaces 22 may be arranged in parallel to the sidewalls 16, 17 rather than being inclined. The engagement surfaces 22 may also merely be of friction increasing material and not having the parallel grooves 31. In addition, the engagement surfaces 22 may as well be attached to the housing body 3 rather than to the cover 4. Yet, as will be visible from FIG. 1 mounting the engagement surfaces 22 at the cover 4 provides for the advantage that the engagement surfaces 22 do not interfere with the refilling process.

Some further alternatives are shown in FIGS. 6 A to D. In FIG. 6A, the engagement surface member 38 is attached at opposite ends in the stacking direction at an attachment surface 35 using attachment members 36 such as screws. In addition, the grooves are only provided on a part of the engagement surface 22. The remainder is substantially the same as in the previous Figures, wherein the engagement surface member 38 also provides for the function of the tab in the previous embodiments.

Figure 6A:
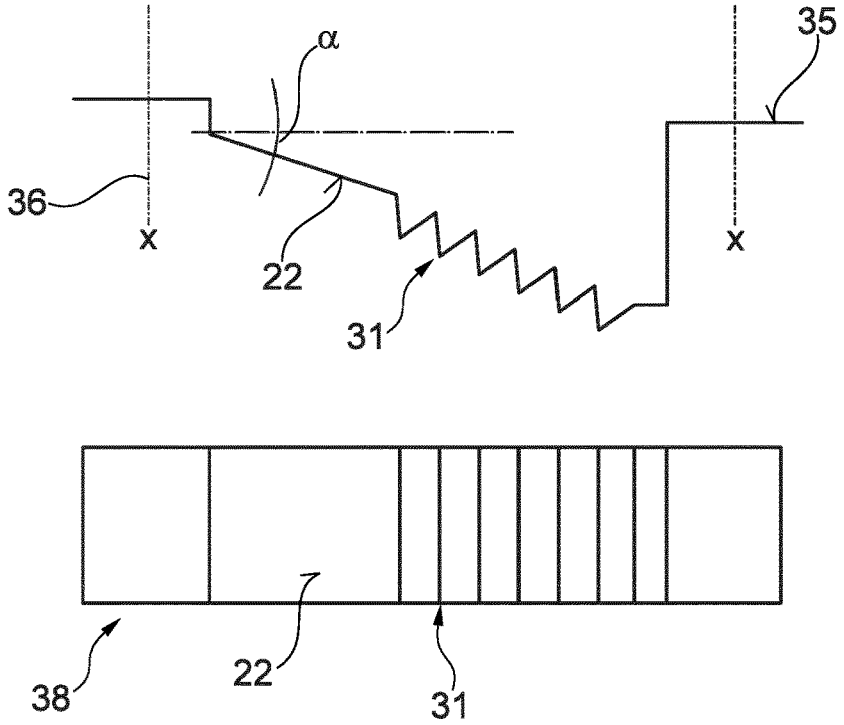
FIGS. 6A-D show an alternative tab or alternative engagement surface members in top and side view.
Figure 6B:
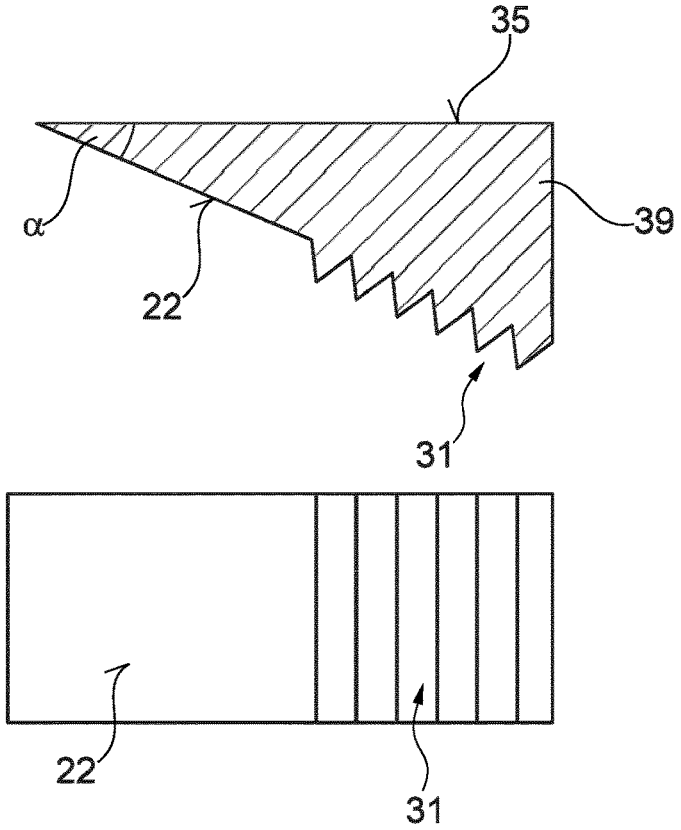

FIG. 6B shows a solid engagement surface member 39 made of elastic material, such as rubber. The engagement surface member 39 may, e.g., glued to the side walls 16, 17 at its attachment surface. The rest is similar to FIG. 6A.

Figure 6C:
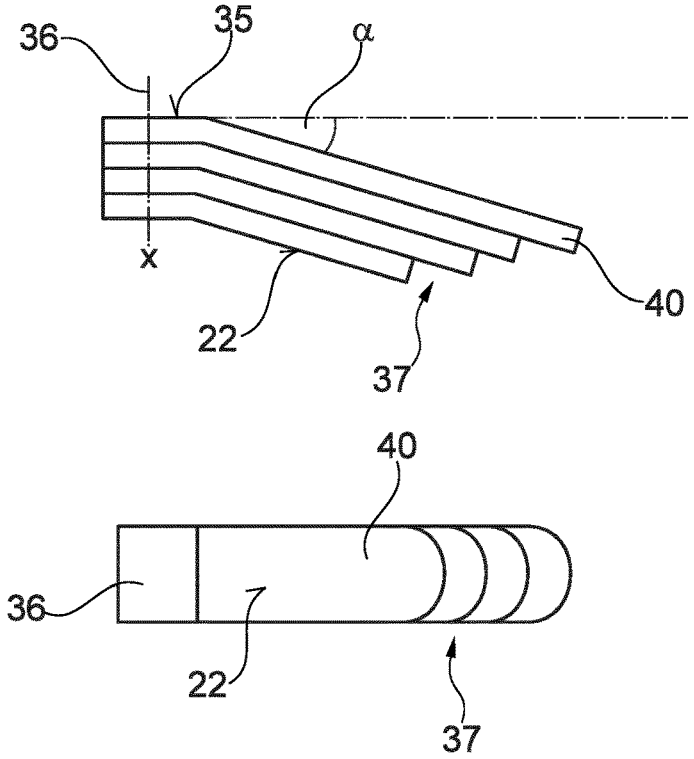

FIG. 6C shows a stack of metal spring members 40 having a different length to create a stepped portion having a plurality of steps 37 at a part of the engagement surface 22. Accordingly, a higher friction is created similar to the use of the previously described grooves.

Figure 6D:
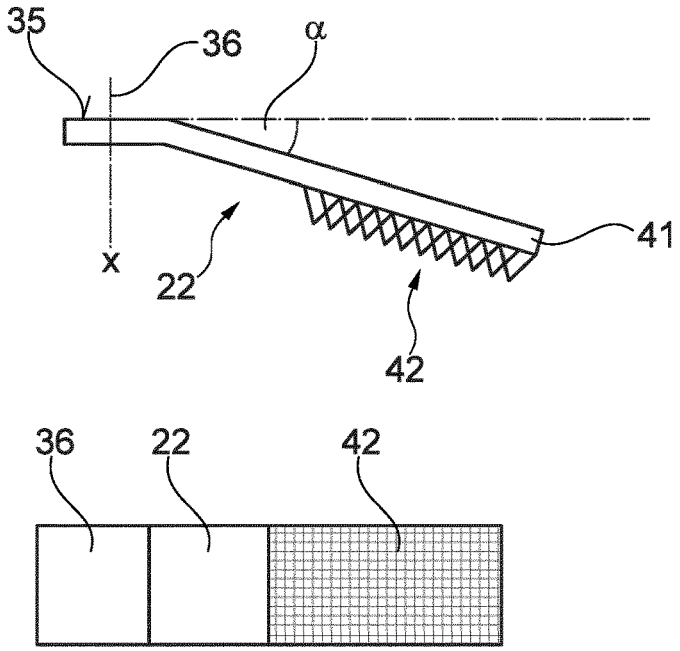

FIG. 6D shows a simple straight tab 41 attached to the side walls 16, 17 by an attachment member 36 as described with respect to FIG. 6A above. In addition and to increase the friction, a part of the engagement surface 22 is textured defining a textured surface 42. The surface may for example be textured by lasering.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A dispenser for dispensing sheet products stacked in a stacking direction, comprising:

a housing having a pair of first opposite side walls and a pair of second opposite side walls defining an interior space configured to accommodate a stack of the sheet products, the housing defining a dispensing opening at a front end of each of the first and second opposite side walls, and an engagement surface arranged at a front-end portion of each of the first opposite side walls closer to one of the second opposite side walls than to the other of the second opposite side walls, wherein each engagement surface is engageable with a respective opposite edge of the sheet products and extends in the stacking direction, wherein the dispenser further comprises a dispensing mechanism, the dispensing mechanism comprising a roller having an axis of rotation and configured to engage with a leading sheet product in the stack of sheet products to dispense at least a portion of the sheet product through the dispensing opening upon rotation, wherein each engagement surface is arranged between the axis of rotation and the respective second opposite side wall to which each engagement surface is located closer to.

2. The dispenser according to claim 1, wherein each engagement surface is inclined relative to a respective side wall of the first opposite side walls so that a distance between the engagement surfaces decreases towards the dispensing opening.

3. The dispenser according to claim 1, wherein at least one of the engagement surfaces is biased towards the other of the engagement surfaces.

4. The dispenser according to claim 3, wherein at least one of the engagement surfaces is formed on a tab, the tab being elastic in a direction towards the respective side walls of first opposite side walls.

5. The dispenser according to claim 4, wherein the tab is a sheet metal or bent sheet metal.

6. The dispenser according to claim 1, wherein the engagement surfaces are a friction increasing surface or surface-increasing surface.

7. The dispenser according to claim 1, wherein the engagement surfaces each comprise a plurality of parallel grooves arranged in a row in the stacking direction.

8. The dispenser according to claim 1, wherein the housing comprises a housing body and a cover, the cover being movably attached to the housing body for refilling, wherein the engagement surfaces are arranged on and movable together with the cover.

9. The dispenser according to claim 1, further comprising a support plate reciprocally movable within the interior space and having a support surface for supporting the stack of sheet products at one of opposite faces of the stack, wherein the support plate is urged in a direction toward the dispensing opening.

10. The dispenser according to claim 1, wherein a respective length of the engagement surfaces in the stacking direction is different to one another.

* * * * *